US010880668B1

(12) United States Patent
Robinson et al.

(10) Patent No.: US 10,880,668 B1
(45) Date of Patent: Dec. 29, 2020

(54) SCALING OF VIRTUAL AUDIO CONTENT USING REVERBERENT ENERGY

(71) Applicant: Facebook Technologies, LLC, Menlo Park, CA (US)

(72) Inventors: Philip Robinson, Seattle, WA (US); Carl Schissler, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/570,314

(22) Filed: Sep. 13, 2019

(51) Int. Cl.

| | |
|---|---|
| ***H04R 5/02*** | (2006.01) |
| ***H04S 7/00*** | (2006.01) |
| ***H04R 5/033*** | (2006.01) |
| ***H04R 5/04*** | (2006.01) |

(52) U.S. Cl.
CPC ..... *H04S 7/304* (2013.01); *H04R 5/033* (2013.01); *H04R 5/04* (2013.01); *H04S 7/307* (2013.01); *H04S 2420/01* (2013.01)

(58) Field of Classification Search
CPC ..... H04S 7/304; H04S 7/305; H04S 7/307; H04S 2420/01; H04R 5/033; H04R 5/04
USPC ..... 381/300
See application file for complete search history.

(56) References Cited

U.S. PATENT DOCUMENTS

2019/0387352 A1* 12/2019 Jot ..... G10K 15/10

* cited by examiner

*Primary Examiner* — Ammar T Hamid
(74) *Attorney, Agent, or Firm* — Fenwick & West LLP

(57) ABSTRACT

A method for scaling audio content using reverberant energy for the placement of virtual audio sources in an artificial reality experience. The method comprises obtaining a set of critical distance parameters. The set of critical distance parameters include at least a reverberation time of a local area and a geometry of the local area. The method further comprises determining a critical distance for the local area based on the set of critical distance parameters and scaling an amplitude of audio content based in part on the critical distance and a distance between a target location in the local area and an artificial reality headset in the local area. The method further comprises presenting the audio content by the headset in accordance with the scaled amplitude.

17 Claims, 6 Drawing Sheets

SCALING OF VIRTUAL AUDIO CONTENT USING REVERBERENT ENERGY

BACKGROUND

This disclosure relates generally to artificial reality systems, and more specifically to the scaling of virtual audio content using reverberant energy for artificial reality systems.

Head mounted displays (HMDs) may be used to present virtual and/or augmented information to a user. For example, an augmented reality (AR) headset or a virtual reality (VR) headset can be used to simulate an augmented/virtual reality. When placing a virtual audio source in a scene using an AR and/or VR device, it is important to incorporate the acoustical parameters of a local area into the audio signals, so that the virtual audio (i.e., audio content that appears to be emitted by a virtual audio source) is seamlessly blended with real audio (i.e., audio content emitted by a real audio source). Acoustical parameters of the local area are unique to each source-receiver relationship in the local area. As such, measuring the acoustical parameters of the local area from every possible audio source and/or receiver position within the local area is generally not feasible. Conventionally, these properties are passively estimated and thereby create an augmented/virtual reality where the virtual audio does not blend well with the real audio.

SUMMARY

An artificial reality headset blends audio content from both virtual audio sources and real audio sources as part of an artificial reality experience that may be provided to a user of the headset. A virtual audio source is a virtual object that appears to be emitting sound (i.e., virtual audio) and is placed in an artificial reality environment that a user of a headset is experiencing. A real audio source is a real object that is emitting sound waves (i.e. real audio) in the real-world environment that a user of headset is experiencing.

Virtual audio and real audio comprise two main components, a direct audio component and a reverberant audio component. The direct audio component is sound waves that reach the ear of a listener directly from the audio source. The reverberant audio component is sound waves that are reflected off of a plurality of surfaces before reaching the ear of a listener. The direct audio and the reverberant audio can be described in terms of energy (i.e., direct energy and reverberant energy). A direct energy to reverberant energy ratio is used to blend virtual audio with real audio. This present disclosure determines the direct energy to reverberant energy ratio of a target location (e.g., a virtual audio source location) in the local area by determining at least a reverberation time of the local area and a volume of the local area. With these values, a critical distance can be determined and the direct energy to reverberant energy ratio for a virtual audio source at any target location in the local area can be extrapolated from the determined critical distance value. The critical distance can be used to scale the reverberant energy and the direct energy to reverberant energy ratio can be used to dynamically scale an amplitude of the direct energy of the audio content. By scaling both components (i.e. the direct and reverberant components) of the audio content, a virtual audio source may be placed within the local area such that the virtual audio blends seamlessly with the real audio.

Some embodiments relate to a method. The method may be for scaling of virtual audio content using reverberant energy for artificial reality systems. The method may comprise obtaining a set of critical distance parameters. The set of critical distance parameters may include at least a reverberation time of the local area and a geometry of the local area. The method may further comprise determining a critical distance for the local area based on the set of critical distance parameters. The method may further comprise scaling an amplitude of audio content based in part on the critical distance and a distance between a target location in the local area and a headset location in the local area. The method may further comprise presenting the audio content in accordance with the scaled amplitude by an audio system of the headset. In some embodiments, steps of the method may be stored as instructions on a non-transitory computer-readable medium and the instructions may be executed by one or more processors.

Some embodiments relate to an audio system. In some embodiments, the audio system comprises a transducer array configured to present audio content to a user wearing a headset. The audio system may further comprise a controller configured to obtain a set of critical distance parameters, which are then used to determine a critical distance for a local area. The set of critical distance parameters include at least a reverberation time of the local area and a geometry of the local area. The controller is further configured to scale an amplitude of audio content based in part on the critical distance and a distance between a target location in the local area and a headset location in the local area. The controller is further configured to present the audio content via the transducer array in accordance with the scaled amplitude to a user wearing a headset that includes the audio system.

Figure 1A:
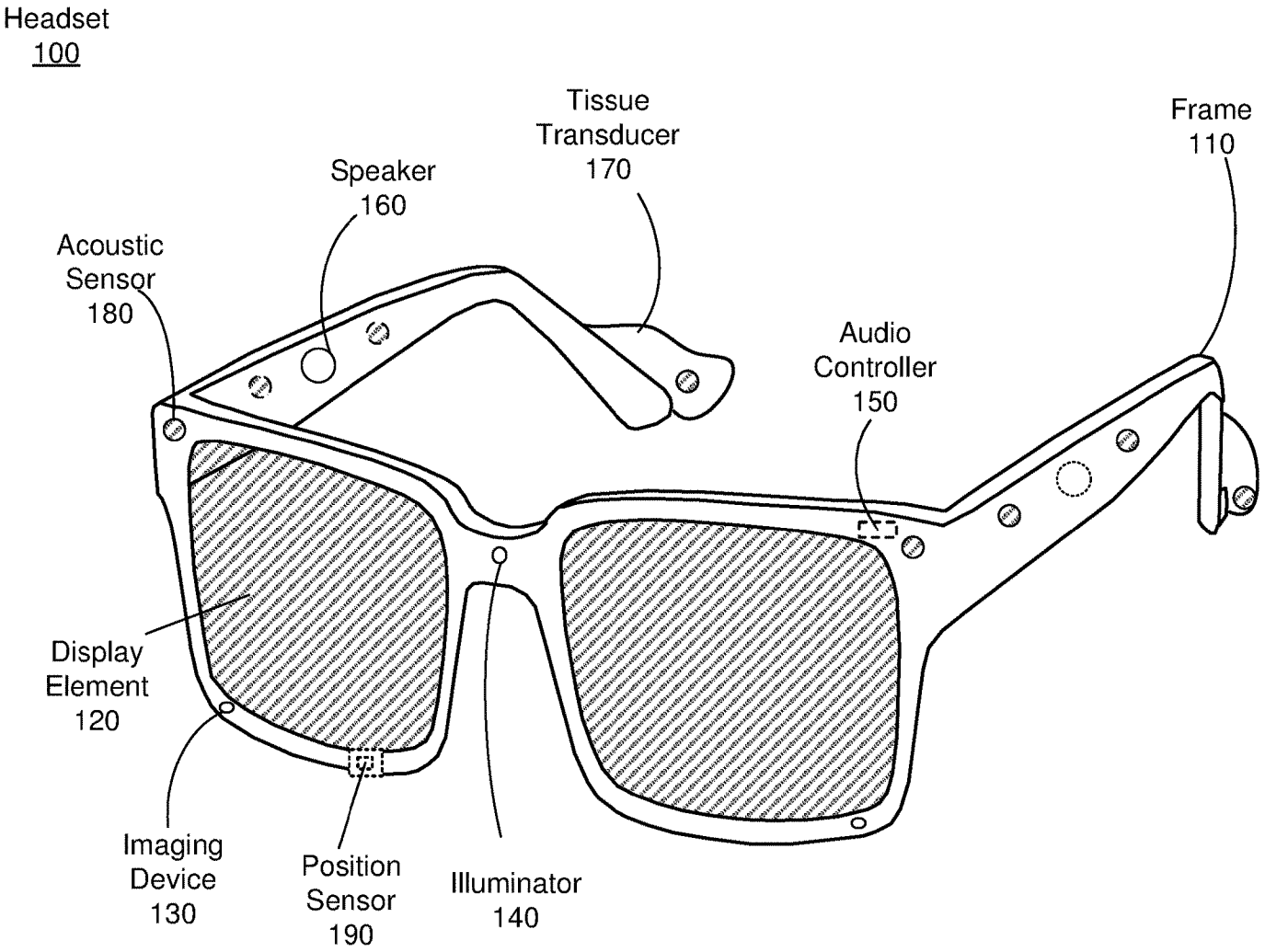
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Configuration Overview

Techniques and systems for scaling virtual audio content using reverberant energy for artificial reality systems are disclosed. In order for audio content that appears to be emitted from a virtual audio source (i.e., virtual audio) to blend seamlessly with audio content that is being emitted from a real audio source, an amplitude of the virtual audio is scaled. Virtual audio and real audio comprise two main components, a direct audio component and a reverberant audio component. The direct audio component is sound waves that reach the ear of a listener directly from the audio source. The reverberant audio component is sound waves that are reflected off of a plurality of surfaces before reaching the ear of a listener. The direct audio and the reverberant audio can be described in terms of energy (i.e., direct energy and reverberant energy). An audio system presented herein provides scaled virtual audio content to a user via an artificial reality headset. The audio content is amplitude scaled according to a critical distance and a distance between a target location (e.g., a virtual audio source location) in a local area and a user wearing a headset (e.g., the headset location) in the local area.

To scale the amplitude of audio content, a direct energy to reverberant energy ratio is determined. The direct energy to reverberant energy ratio may be calculated by determining one or more acoustical parameters of the local area. The acoustical parameters may include a reverberation time of the local area and the geometry of the local area. The reverberation time of the local area is a measurement of time it takes for the reverberant energy to dissipate a predetermined amount of decibels (dB) below its original value from the instant that the audio source ceases to emit sound. The reverberation time may be measured in seconds (s) or some other unit of time. The volume of the local area is the amount of space that is enclosed within the local area. The volume is typically measured in cubed meters ($m^3$) or some other measure of volume. The acoustical parameters of the local area may be considered in a set of critical distance parameters. A set of critical distance parameters may be used to calculate a critical distance. The critical distance is the distance from the audio source at which the reverberant energy value is equal to the direct energy value for a given frequency band in the local area. In some embodiments, the set of critical distance parameters may also include a directivity value of the audio source. The directivity value of the audio source is a measure of the directional characteristic of an audio source. The directivity value is typically measured in dB.

A direct energy to reverberant energy ratio of the audio source at any target location (e.g., at any distance from the user of the headset) in the local area can be extrapolated from the determined critical distance value. The reverberant energy is scaled in proportion to the inverse of the squared determined critical distance value for the local area. Further, the direct energy is dynamically scaled in proportion to the inverse of the squared distance between the target location and the headset location in the local area as the user moves throughout the local area. The ratio of the direct energy to reverberant energy may be used as a scaling factor to scale the sound energy of the audio content. By scaling audio content using the scaling factor, a virtual audio source may be placed within the local area such that the virtual audio blends seamlessly with the real audio.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

Example Headsets

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

Note that in some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof. In one embodiment, the computed depth information may be used to determine the location of the headset 100. For instance, the computed depth information may be shared with an external system (e.g., a mapping server) via a network. The external system may include a database where depth information and associated location information may be stored. The computed depth information may be used to query the database to determine the associated location information. The associated location information may be shared with the headset 100 via the network. Additionally, the location of the headset may be used to determine one or more acoustical parameter of the local area (e.g., the reverberation time or the geometry of the local area) (as described more below with regard to FIG. 5). In other embodiments, the DCA controller computes the volume of the local area. When the DCA includes two or more imaging devices 130, the DCA controller analyzes the captured images to determine the volume of the local area.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents audio content to the user. The audio content presented to the user is virtual audio or sound that appears to be emitted from a virtual audio source. In some embodiments, the transducer array emits a sound that is directed outwards into the local area. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds (e.g., real audio in the local area or a sound emitted from the transducer array) within the local area of the headset 100. The sensor array includes a plurality of acoustic sensors 180. An acoustic sensor 180 captures sounds emitted from one or more real audio sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of real audio sources, form beams in the direction of real audio sources, classify real audio sources, determine a directivity value of a classified real audio sources, determine a reverberation time (e.g., RT60) of the local area, determine a critical distance measurement of the local area, generate sound filters to present virtual audio via the speakers 160, or some combination thereof. The audio controller 150 and the audio controller modules will be described more below with regard to FIG. 3.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine acoustical parameters of the local area. The acoustical parameters of the local area may include a reverberation time of the local area, a geometry of the local area, a critical distance measurement of the local area, some other acoustical parameter of the local area, or some combination thereof. In one embodiment, the determination of the acoustical parameters takes place in the audio controller 150. Furthermore, the position sensor 190 tracks the position (e.g., location and pose) of the headset 100 within the room. Additional details regarding the components of the headset 100 are discussed below in connection with FIG. 5.

Figure 1B:
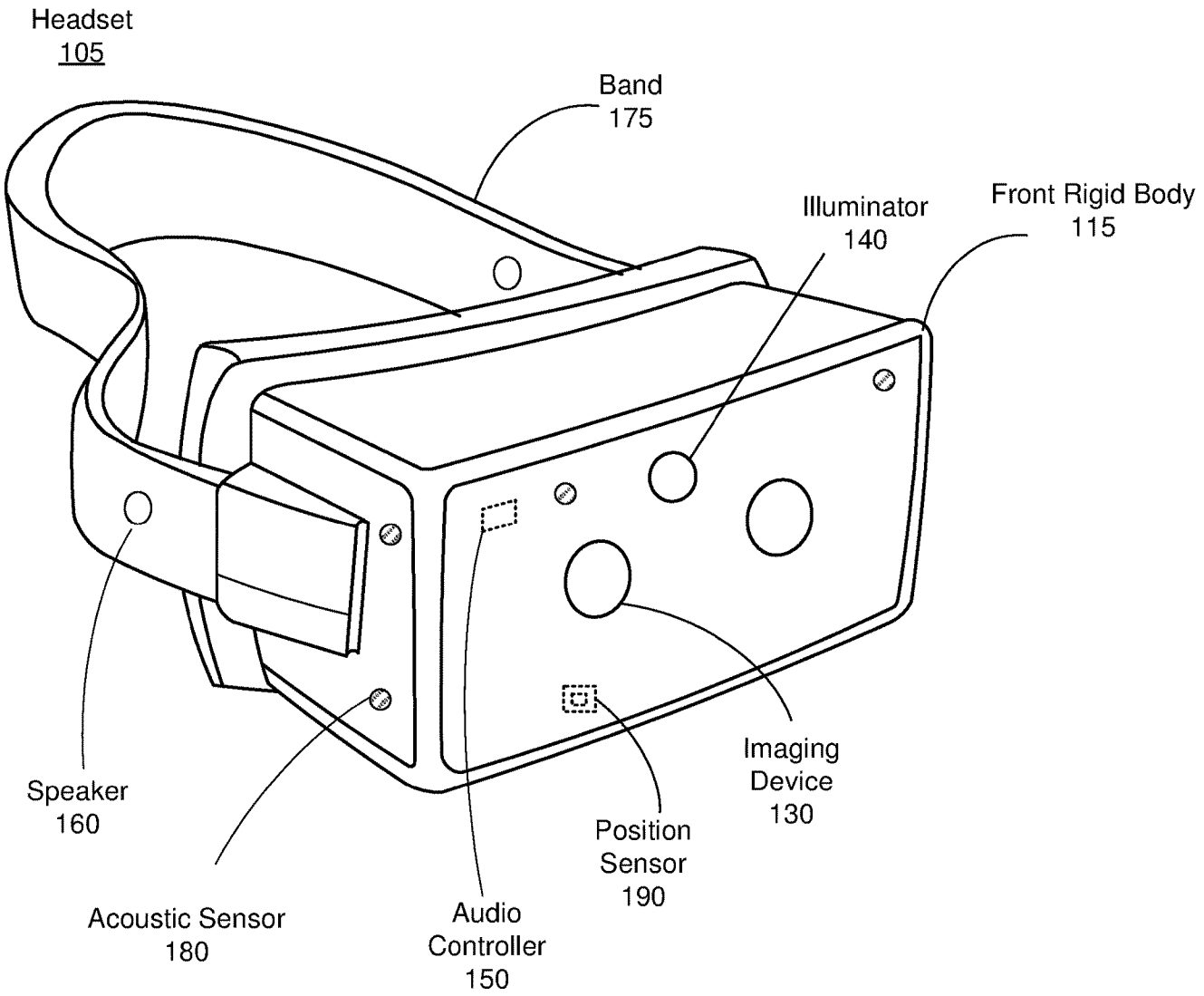
FIG. 1B is a perspective view of a headset implemented as a head-mounted display, in accordance with one or more embodiments.

FIG. 1B is a perspective view of a headset 105 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. In some embodiments, the speakers 160 are on the band 175. However, in other embodiments, some or all of the speakers 160 may be on the front rigid body 115. And, in some embodiments, the headset 105 may include more speakers 160 than the two shown in FIG. 1B.

Audio Content Environment

Figure 2:
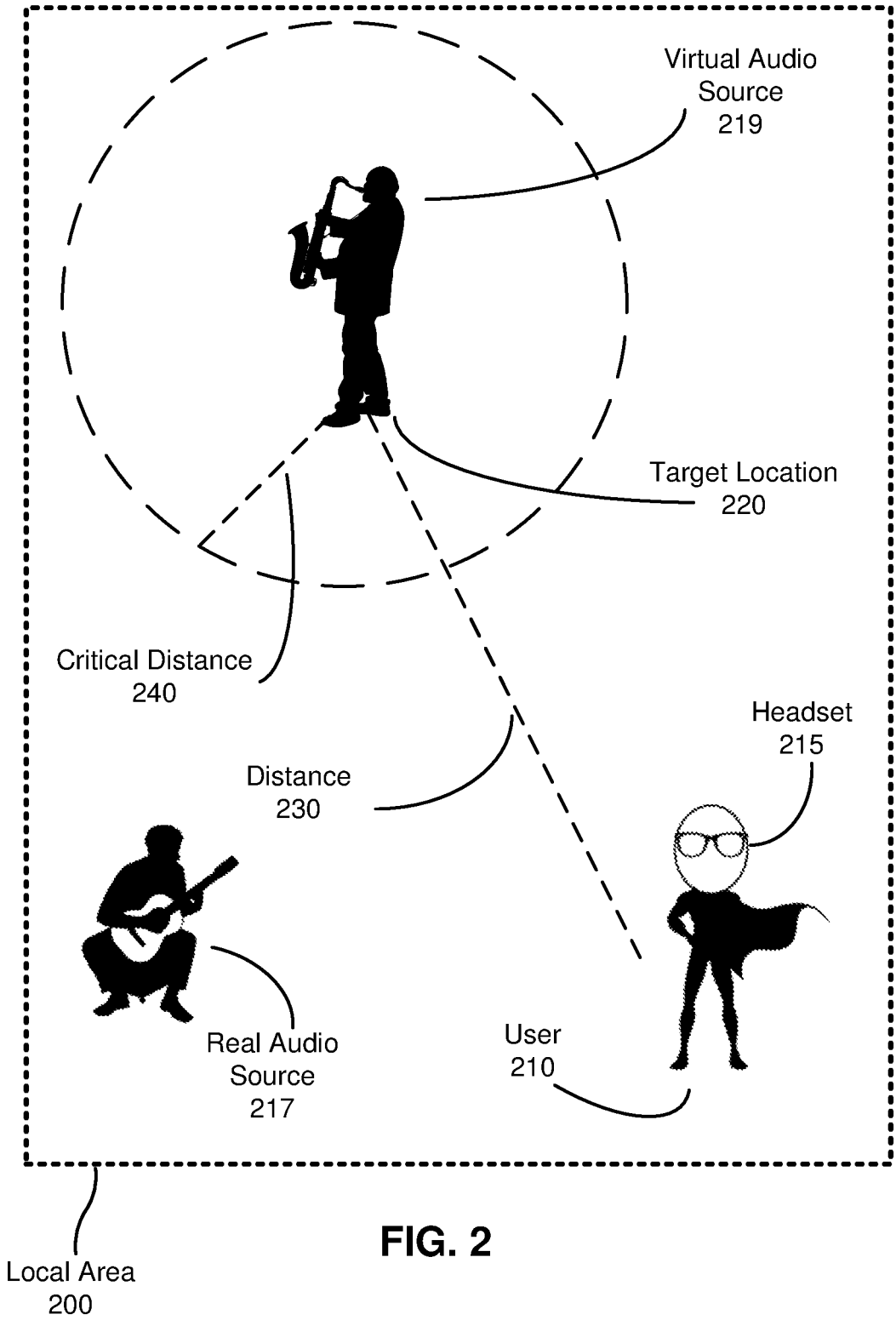
FIG. 2 illustrates a local area of a user of a headset, in accordance with one or more embodiments.

FIG. 2 illustrates a local area 200 of a user 210 of a headset 215, in accordance with one or more embodiments. In the illustrated example, the local area 200 represents a room in a building, but could be any other space. For instance, the local area 200 may be enclosed (e.g., a room) or open (e.g., in a field). The user 210 and the headset 215 (e.g., the headset 100 or headset 105) are located within the local area 200. In one embodiment, the headset 215 may determine a location of the user 210 within the local area 200. For example, a DCA of the headset 215 may determine depth information by illuminating and imaging the local area 200 by using one or more imaging devices (e.g., the one or more imaging devices 130) and an illuminator (e.g., the illuminator 140). The DCA controller may compute depth information. In some embodiments, the depth information is provided to a mapping server (i.e. an external system to the headset 215) and the mapping server may match the depth information to known location information (e.g., a model of the local area 200 and the location of the headset 215 within the local area 200). The known location information may be shared by the mapping server to the headset 215. In some embodiments, the headset 215 may determine a geometry of the local area 200. The geometry of the local area 200 may include a volume of the local area 200. In some embodiments, the DCA controller computes the volume of the local area 200. In some embodiments, the volume of the local area 200 may be determined by the headset 215 by providing the computed depth information to the mapping server and receiving an associated room geometry based on the depth information from the mapping server.

In FIG. 2, a real audio source 217 is located within the local area 200. In another embodiment, one or more real audio sources may be located within the local area 200. The real audio source 217 is depicted as a musician playing the guitar. The user 210 would see the real audio source 217 and hear the real audio emitting from the real audio source 217. In one embodiment, the headset 215 may be capturing images of the local area 200 by using one or more imaging devices (e.g., the one or more imaging devices 130). These images may undergo one or more image and/or video processing techniques to identify the real audio source 217. In some embodiments, the headset 215 may be capturing the real audio by using a plurality of acoustic sensors (e.g., the acoustic sensors 180) in a sensory array. The real audio content may include a song the musician is playing with the guitar. The headset 215 may process the captured real audio content in an audio controller (e.g., the audio controller 150). The audio controller may be configured to determine the reverberation time (e.g., RT60) of the local area 200 based on the captured real audio content. In some embodiments, the audio controller determines the reverberation time of the local area by emitting a sound from the headset 215 and measuring the corresponding reverberation time of the local area 200.

In FIG. 2, a virtual audio source 219 is also located within the local area 200. In another embodiment, one or more virtual audio sources may be located within the local area 200. The virtual audio source 219 is depicted as a musician playing the saxophone. The user 210 would see the virtual audio source 219 and hear the virtual audio content that appears to be emitted from the virtual audio source 219. The virtual audio source 219 may be identified by a type (e.g., a person, a dog, a loudspeaker, etc.). In one embodiment, the type may be queried in a database to determine an associated directivity value for the type of audio source. For example, the virtual content being displayed by the headset 215 to the user 210 includes a person playing a saxophone. The saxophone is the virtual audio source and the type queried in the database is saxophone.

The virtual audio source 219 is located at a target location 220 within the local area 200. In some embodiments, the local area may include multiple virtual audio sources, each located at a respective target location. The target location 220 is located at a distance 230 from the user 210. In one embodiment, the distance between the target location 220 and the headset 215 location is a known quantity based on the virtual content presented to the user. For instance, a virtual content creator designs the virtual content so that the headset 215 displays the musician playing the saxophone at a distance 230 of three meters away from the user 210.

A critical distance 240 is a distance from the target location 220 at which the reverberant energy value and the direct energy value of the virtual audio content are equal for a given frequency band in the local area 200. Both real audio sources and virtual audio sources have associated critical distance values for the local area 200. In FIG. 2, the critical distance 240 for the virtual audio source 219 is illustrated and the critical distance for the real audio source 217 is not shown. In one embodiment, the critical distance 240 may be calculated by the audio system of the headset 215 using information previously gathered about the acoustic parameters of the local area 200 (as described below with regard to FIG. 3). In some embodiments, the critical distance 240 may be retrieved by the audio system of the headset 215 from the mapping server (as described below with regard to FIG. 3).

The critical distance 240 may be used to calculate the amount of amplitude scaling needed so that audio content presented to the user 210 by the headset 215 (i.e., virtual audio content) blends with the real audio seamlessly. In one embodiment, the critical distance 240 may be used by the virtual content creator. The virtual content creator may use the critical distance to extrapolate a direct energy to reverberant energy ratio for the virtual audio source 219 at any target location in the local area 200. Further, the direct energy may be dynamically scaled in proportion to the inverse of the distance 230 squared to determine a first sound energy at the distance 230. The reverberant energy may be scaled in proportion to the inverse of the critical distance 240 squared to determine a second sound energy at the critical distance 240. The ratio of the first sound energy to the second sound energy (i.e., the ratio of the direct energy to the reverberant energy) is a scaling factor that may be used to scale the amplitude of audio content. The direct energy amplitude of the virtual audio source 219 may be dynamically scaled in proportion to the scaling factor as the user 210 moves around the local area 200 and the distance 230 changes. The reverberant energy of the virtual audio source 219 remains constant regardless of the distance 230 in the local area 200.

Audio System

Figure 3:
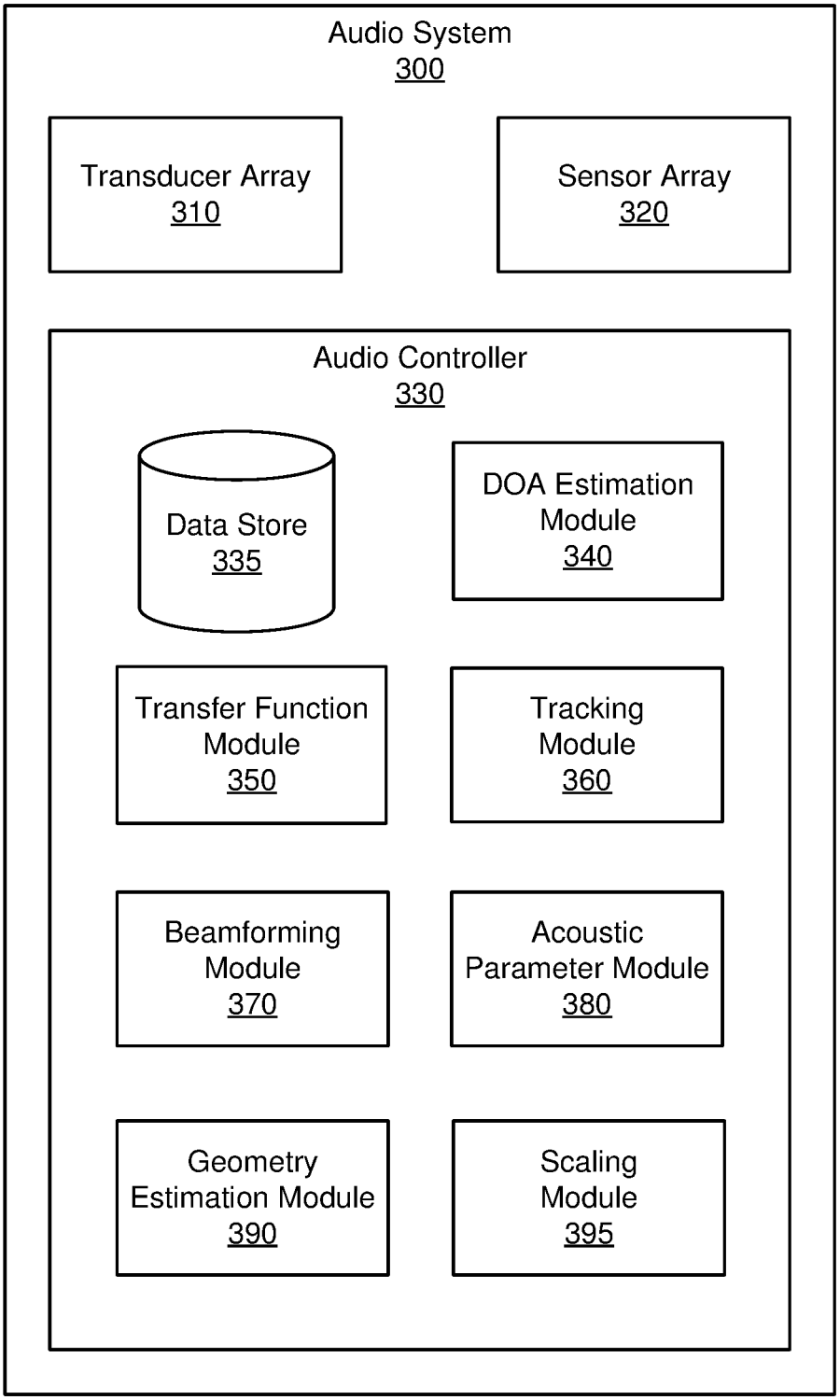
FIG. 3 is a block diagram of an audio system, in accordance with one or more embodiments.

FIG. 3 is a block diagram of an audio system 300, in accordance with one or more embodiments. The audio system in FIG. 1A or FIG. 1B may be an embodiment of the audio system 300. The audio system 300 generates one or more acoustic transfer functions for a user. The audio system 300 may then use the one or more acoustic transfer functions to generate audio content for the user. In the embodiment of FIG. 3, the audio system 300 includes a transducer array 310, a sensor array 320, and an audio controller 330. Some embodiments of the audio system 300 have different components than those described here. Similarly, in some cases, functions can be distributed among the components in a different manner than is described here.

The transducer array 310 is configured to present audio content. The transducer array 310 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 310 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 310 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 330, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 310 generates audio content in accordance with instructions from the audio controller 330. In some embodiments, the audio content is spatialized. Spatialized audio content is audio content that appears to originate from a particular direction and/or target region (e.g., an object in the local area and/or a virtual audio source). For example, spatialized audio content can make it appear that sound is originating from a virtual singer across a room from a user of the audio system 300. In some embodiments, the audio content amplitude is scaled based on a direct energy to reverberant energy ratio. The amplitude scaled audio content is audio content presented to the user of the audio system 300 that blends seamlessly with real audio content in the local area. The transducer array 310 may be coupled to a wearable device (e.g., the headset 100 or the headset 105). In alternate embodiments, the transducer array 310 may be a plurality of speakers that are separate from the wearable device (e.g., coupled to an external console).

The sensor array 320 detects sounds (e.g., real audio in the local area or a sound emitted from the transducer array 310) within a local area surrounding the sensor array 320. The sensor array 320 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 320 is configured to monitor the audio content generated by the transducer array 310 using at least some of the plurality of acoustic sensors. Increasing the number of sensors may improve the accuracy of information (e.g., directionality) describing a sound field produced by the transducer array 310 and/or sound from the local area.

The audio controller 330 controls operation of the audio system 300. In the embodiment of FIG. 3, the audio controller 330 includes a data store 335, a DOA estimation module 340, a transfer function module 350, a tracking module 360, a beamforming module 370, an acoustic parameter module 380, a geometry estimation module 390, and a scaling module 395. The audio controller 330 may be located inside a headset, in some embodiments. Some embodiments of the audio controller 330 have different components than those described here. Similarly, functions can be distributed among the components in different manners than described here. For example, some functions of the controller may be performed external to the headset.

The data store 335 stores data for use by the audio system 300. Data in the data store 335 may include real audio recorded in the local area of the audio system 300, directivity values associated with each audio source, audio content to be presented by the audio system 300, head-related transfer functions (HRTFs), transfer functions for one or more sensors, array transfer functions (ATFs) for one or more of the acoustic sensors, target locations, geometry of the local area, direction of arrival estimates, reverberation time (e.g., RT60) of the local area, critical distance measurements for the local area, distance measurements (e.g., distance between the target location and the headset location), sound filters, and other data relevant for use by the audio system 300, or any combination thereof.

The DOA estimation module 340 is configured to localize audio sources in the local area based in part on information from the sensor array 320. Localization is a process of determining where audio sources are located relative to the user of the audio system 300. The DOA estimation module 340 performs a DOA analysis to localize one or more audio sources within the local area. The DOA analysis may include analyzing the intensity, spectra, and/or arrival time of each sound at the sensor array 320 to determine the direction from which the sounds originated. In some cases, the DOA analysis may include any suitable algorithm for analyzing a surrounding acoustic environment in which the audio system 300 is located.

For example, the DOA analysis may be designed to receive input signals from the sensor array 320 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 320 received the direct-path audio signal. The determined angle may then be used to identify the DOA for the received input signal. Other algorithms not listed above may also be used alone or in combination with the above algorithms to determine DOA.

In some embodiments, the DOA estimation module 340 may also determine the DOA with respect to an absolute position of the audio system 300 within the local area. The position of the sensor array 320 may be received from an external system (e.g., some other component of a headset, an artificial reality console, a mapping server, a position sensor (e.g., the position sensor 190), etc.). The received position information may include a location and/or an orientation of some or all of the audio system 300 (e.g., of the sensor array 320). The DOA estimation module 340 may update the estimated DOA based on the received position information.

The transfer function module 350 is configured to generate one or more acoustic transfer functions. Generally, a transfer function is a mathematical function giving a corresponding output value for each possible input value. Based on parameters of the detected sounds, the transfer function module 350 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the audio sources and the corresponding sound received by the acoustic sensors in the sensor array 320. Accordingly, for an audio source there is a corresponding transfer function for each of the acoustic sensors in the sensor array 320. And collectively the set of transfer functions is referred to as an ATF. Accordingly, for each audio source there is a corresponding ATF. Note that the audio source may be, e.g., someone or something generating sound in the local area, the user, or one or more transducers of the transducer array 310. The ATF for a particular audio source location relative to the sensor array 320 may differ from user to user due to a person's anatomy (e.g., ear shape, shoulders, etc.) that affects the sound as it travels to the person's ears. Accordingly, the ATFs of the sensor array 320 are personalized for each user of the audio system 300.

In some embodiments, the transfer function module 350 determines one or more HRTFs for a user of the audio system 300. The HRTF characterizes how an ear receives a sound from a point in space. The HRTF for a particular audio source location relative to a person is unique to each ear of the person (and is unique to the person) due to the person's anatomy (e.g., ear shape, shoulders, etc.) that affects the sound as it travels to the person's ears. In some embodiments, the transfer function module 350 may determine HRTFs for the user using a calibration process. In some embodiments, the transfer function module 350 may provide information about the user to a remote system. The remote system determines a set of HRTFs that are customized to the user using, e.g., machine learning, and provides the customized set of HRTFs to the audio system 300.

The tracking module 360 is configured to track locations of one or more audio sources. The tracking module 360 may compare current DOA estimates and compare them with a stored history of previous DOA estimates. In some embodiments, the audio system 300 may recalculate DOA estimates on a periodic schedule, such as once per second, or once per millisecond. The tracking module may compare the current DOA estimates with previous DOA estimates, and in response to a change in a DOA estimate for an audio source, the tracking module 360 may determine that the audio source moved. In some embodiments, the tracking module 360 may detect a change in location based on visual information received from the headset or some other external source. The tracking module 360 may track the movement of one or more audio sources over time. The tracking module 360 may store values for a number of audio sources and a location of each audio source at each point in time. In response to a change in a value of the number or locations of the audio sources, the tracking module 360 may determine that an audio source moved. The tracking module 360 may calculate an estimate of the localization variance. The localization variance may be used as a confidence level for each determination of a change in movement.

The beamforming module 370 is configured to process one or more ATFs to selectively emphasize sounds from audio sources within a certain area while de-emphasizing sounds from other areas. In analyzing sounds detected by the sensor array 320, the beamforming module 370 may combine information from different acoustic sensors to emphasize sound associated from a particular region of the local area while deemphasizing sound that is from outside of the region. The beamforming module 370 may isolate an audio signal associated with sound from a particular audio source from other audio sources in the local area based on, e.g., different DOA estimates from the DOA estimation module 340 and the tracking module 360. The beamforming module 370 may thus selectively analyze discrete audio sources in the local area. In some embodiments, the beamforming module 370 may enhance a signal from an audio source. For example, the beamforming module 370 may apply sound filters which eliminate signals above, below, or between certain frequencies. Signal enhancement acts to enhance sounds associated with a given identified audio source relative to other sounds detected by the sensor array 320.

The acoustic parameter module 380 is configured to determine one or more of the acoustic parameters of input signals (e.g., real audio emitted from a real audio source or a sound emitted from a headset) received by the sensor array 320. The acoustic parameters describe acoustic properties of a local area. The acoustic parameters may further include, e.g., a reverberation time (e.g., RT60), a reverberation energy value (e.g., the collection of all reflected sound energy), a room impulse response, some other acoustic property of the local area, or some combination thereof. The acoustic parameters of the local area are included in a set of critical distance parameters (as described more below with regard to the scaling module 395). In one embodiment, the acoustic parameter module 380 calculates one or more of the acoustic parameters. For example, the acoustic parameter module 380 analyzes the real audio recorded in the local area to determine one or more acoustic parameters for the sound emitted from the real audio source. The recording may be analyzed to determine the reverberation energy of the sound and the reverberation time of the local area. In some embodiments, the acoustic parameter module 380 analyzes a sound emitted from the audio system 300 to determine one or more acoustic parameters. The audio system 300 may emit a sound from the transducer array 310 and may record the sound with the sensor array 320. The recording may be analyzed to determine the reverberation energy and the reverberation time of the local area. For instance, to determine the reverberation time (e.g., RT60), the recording may be analyzed to determine how long it takes for the measured reverberant energy to dissipate 60 dB below its original value from the instant that the audio system 300 ceases to emit the sound. In some embodiments, the acoustic parameter module 380 updates the mapping server with determined acoustic parameters. The determined acoustic parameters may be shared with the mapping server via the network and added to a database.

In some embodiments, the acoustic parameter module 380 receives one or more of the acoustic parameters from the mapping server. For example, position information of the audio system 300 may be received by the DOA estimation module 340 from an external system (e.g., some other component of a headset, an artificial reality console, a mapping server, a position sensor (e.g., the position sensor 190), etc.). The position information may include a location of the audio system 300. The acoustic parameter module 380 may share the location information with the mapping server via a network. The mapping server may include a database where location information and associated acoustic parameters may be stored. The location information may be used to query the database to determine the associated acoustic parameters. The associated acoustic parameters may be shared with the acoustic parameter module 380 via the network.

The geometry estimation module 390 is configured to determine a geometry of the local area. The geometry of the local area is information describing the shape and/or size of the local area. The geometry of the local area may include, e.g., an area measurement, a volume measurement, some other information describing the shape and/or size of the local area, or some combination thereof. The geometry of the local area is included in the set of critical distance parameters (as described more below with regard to the scaling module 395). In some embodiments, the geometry estimation module 390 receives the geometry of the local area from a mapping server. For example, position information of the audio system 300 may be received by the DOA estimation module 340 from an external system (e.g., some other component of a headset, an artificial reality console, a mapping server, a position sensor (e.g., the position sensor 190), etc.). The position information may include a location of the audio system 300. The geometry estimation module 390 may share the location information with the mapping server via a network. The mapping server may include a database where location information and associated geometries of local areas may be stored. The location information may be used to query the database to determine the associated geometry of the local area. The associated geometry of the local area may be shared with the geometry estimation module 390 via the network. In other embodiments, the geometry estimation module 390 receives the geometry of the local area from a component of a headset (e.g., a DCA controller). The geometry estimation module 390 may update the mapping server with the received geometry of the local area. The determined geometry of the local area may be shared with the mapping server via the network and added to a database.

The scaling module 395 is configured to scale an amplitude of audio content based in part on the critical distance and a distance between the target location in the local area and the headset location in the local area. The critical distance is determined based on the set of critical distance parameters. In one embodiment, the critical distance may be determined by inputting the set of critical distance parameters into the following equation:

$$d_c = \frac{1}{4}\sqrt{\frac{\gamma A}{\pi}} \approx 0.057\sqrt{\frac{\gamma V}{RT_{60}}} \tag{1}$$

where y is a source directivity value, A is the absorption value of surfaces of the local area, V is the volume of the local area, and $RT_{60}$ is the time for reverberant energy in the local area to decay 60 dB. In some embodiments, the critical distance may be determined by receiving the critical distance value from the mapping server via a network. The mapping server may include a database where sets of critical distance parameters and associated critical distances may be stored. The set of critical distance parameters may be used to query the database to determine the associated critical distance. The associated critical distance may be shared with the scaling module 395 via the network.

The set of critical distance parameters may include the acoustic parameters (e.g., the acoustic parameters determined in the acoustic parameter module 380), the geometry of the local area (e.g., the geometry of the local area determined in the geometry estimation module 390), some other critical distance parameter, or some combination thereof. For instance, an example of another critical distance parameter is a source directivity value. The source directivity value is a value which measures the degree that emitted sound from an audio source is concentrated in a single direction. In one embodiment, the scaling module 395 may determine the source directivity value for a virtual audio source by querying a database, where the database is queried by audio source type. For example, the virtual content may include a person playing a saxophone. The saxophone is the virtual audio source and the type queried in the database is saxophone. In some embodiments, the database is on a server that is coupled to the audio system 300 via a network.

In some embodiments, the set of critical distance parameters may be associated with a given frequency band (e.g., one octave, ⅓ octave, etc.). For example, a first set of critical distance parameters may have been obtained for an octave band frequency (e.g., frequencies between 707 Hertz (Hz) to 1,414 Hz) and a second set of critical distance parameters may have been obtained for a ⅓ octave band frequency (e.g., frequencies between of 891 Hz to 1,122 Hz). Each set of critical distance parameters may include the acoustic parameters (e.g., the acoustic parameters determined in the acoustic parameter module 380), the geometry of the local area (e.g., the geometry of the local area determined in the geometry estimation module 390), some other critical distance parameter, or some combination thereof. As the set of critical distance parameters are frequency dependent, certain parameters associated with the first frequency band may be different from the parameters associated with the second frequency band. For example, the reverberation time for the first frequency band may be different for the second frequency band. The set of critical distance parameters are used to determine the respective critical distance associated with each frequency band. As such, the first frequency band may have a critical distance that is greater than the critical distance associated with the second frequency band.

Based on the determined critical distance and the distance between a target location in the local area and the headset location, the audio content amplitude is scaled appropriately by the scaling module 395. The scaling module 395 scales the audio content by determining a direct energy to reverberant energy ratio. The direct energy to reverberant energy ratio of the audio source at any target location (e.g., at any distance from the user of the headset) in the local area may be extrapolated from the determined critical distance value. Further, the direct energy is scaled in proportion to the inverse of the squared distance between the target location and the headset location in the local area as can be seen in the following equation:

$$E_{dsf} = \frac{1}{(d_s)^2} \tag{2}$$

where $E_{dsf}$ is the direct energy scale factor and $d_s$ is the distance between the target location and the headset location. The reverberant energy is scaled in proportion to the inverse of the squared critical distance for the local area as can be seen in the following equation:

$$E_{rsf} = \frac{1}{(d_c)^2} \tag{3}$$

where $E_{rsf}$ is the reverberant energy scale factor and $d_c$ is the critical distance for the local area. The ratio of the direct energy to reverberant energy is a scaling factor that may be used to scale the sound energy of audio content as can be seen in the following equation:

$$\frac{E_{dsf}}{E_{rsf}} = \frac{(d_c)^2}{(d_s)^2} \tag{4}$$

where $E_{dsf}/E_{rsf}$ is the direct energy to reverberant energy ratio.

By scaling audio content using the direct energy to reverberant energy scaling factor, a virtual audio source may be placed within the local area such that the virtual audio blends seamlessly with the real audio. In one embodiment, the audio content may be audio content emitted from a virtual audio source (e.g., virtual audio) and the virtual audio source may be placed at any target location in the local area. In one embodiment, the scaling module 395 applies sound filters to scale the amplitude of the virtual audio. The sound filters scale the amplitude of the virtual audio by scaling the direct energy of the virtual audio source using the direct energy to reverberant energy scaling factor and the distance between the target location of a virtual audio source and the user. In some embodiments, the sound filters scale the amplitude of the virtual audio by scaling the direct pressure of the virtual audio source using a direct pressure to reverberant pressure scaling factor. The direct pressure to reverberant pressure scaling factor can be seen in the following equation:

$$\frac{P_{dsf}}{P_{rsf}} = \frac{d_c}{d_s} \tag{5}$$

where $P_{dsf}/P_{rsf}$ is the direct pressure to reverberant pressure ratio. The virtual audio for the virtual audio source is scaled using the following equation:

$$y(t)=x_{direct}(t)+x_{reverb}(t)=P_{dsf}*x(t)+P_{rsf}*\text{Reverb}(x(t)) \tag{6}$$

where y(t) is the final audio content for the virtual audio source, $x_{direct}(t)$ is the direct audio direct component, $x_{reverb}(t)$ is the reverberant audio component, $P_{dsf}$ is the direct pressure scale factor, $P_{rsf}$ is the reverberant pressure scale factor, x(t) is the input audio content, Reverb( ) applies reverberation to the input audio (e.g., via artificial reverberation algorithms or via convolution with an impulse response). In some embodiments, sound filters cause the virtual audio to be spatialized, such that the virtual audio content appears to originate from a target region. The scaling module 395 may use the HRTFs and/or acoustic parameters to generate the sound filters. The scaling module 395 provides the filtered audio content to the transducer array 310 for presentation to the user.

In some embodiments, the scaling module 395 updates the mapping server with determined critical distance information and direct energy to reverberant energy ratio calculations. The critical distance information and ratio calculations are shared with the mapping server via the network and added to the database.

Method for Scaling Audio Content

Figure 4:
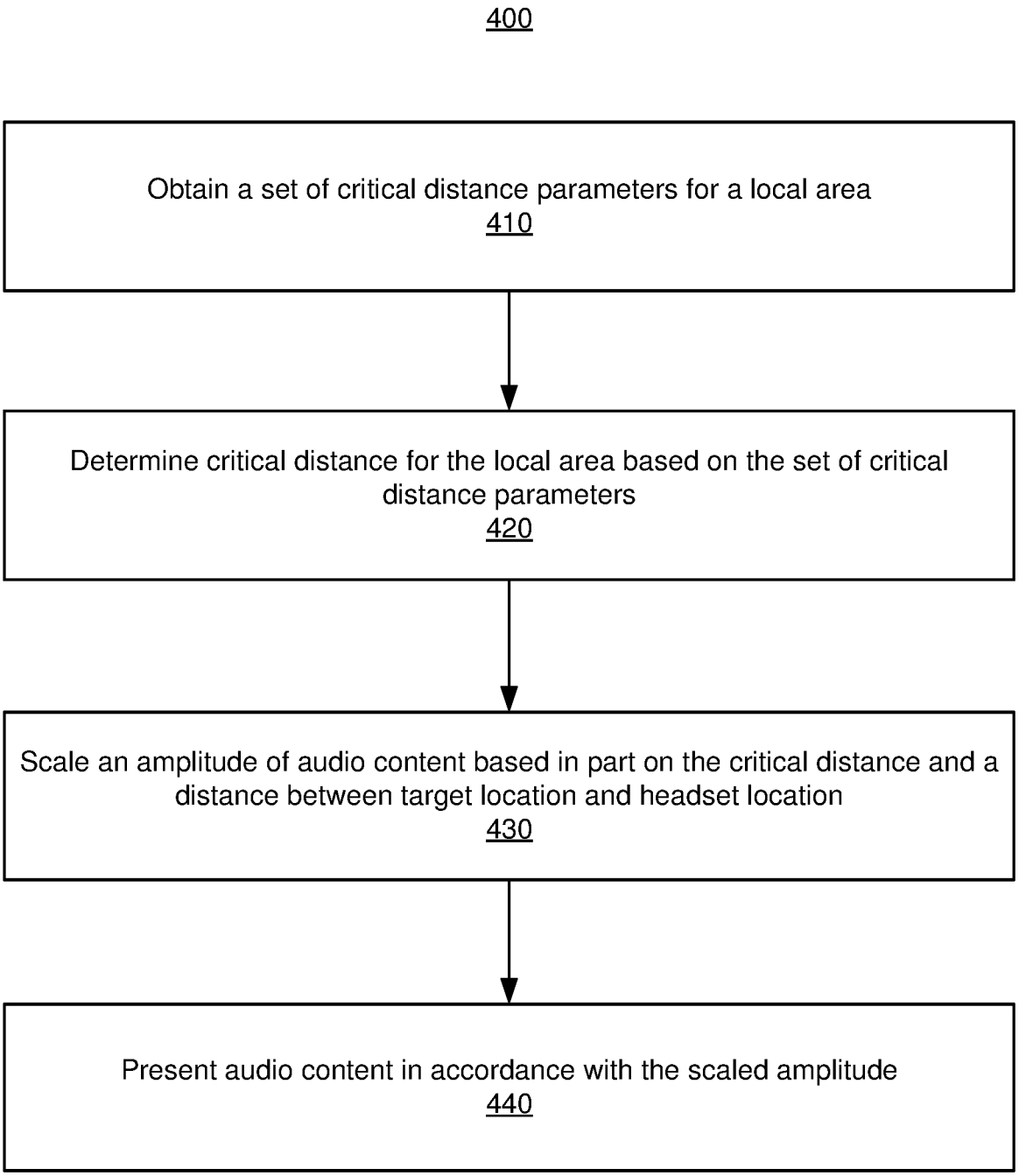
FIG. 4 is a flowchart illustrating a process for scaling audio content, in accordance with one or more embodiments.

FIG. 4 is a flowchart illustrating a process for scaling audio content, in accordance with one or more embodiments. The process shown in FIG. 4 may be performed by components of an audio system (e.g., the audio system 300). Other entities may perform some or all of the steps in FIG. 4 in other embodiments. Embodiments may include different and/or additional steps, or perform the steps in different orders.

The audio system obtains 410 a set of critical distance parameters for a local area. The set of critical distance parameters are parameters used to solve for the critical distance of an audio source. The set of critical distance parameters may include acoustic parameters that describe acoustic properties of a local area and a geometry of the local area. In some embodiments, the audio system (e.g., via the acoustic parameter module 380) determines one or more acoustic parameters for the local area. For example, the audio system may analyze a sound emitted from the audio system to determine one or more acoustic parameter. In some examples, the audio system receives one or more of the acoustic parameters from an external system (e.g., a mapping server). In other embodiments, the audio system (e.g., via the geometry estimation module 390) obtains information pertaining to the geometry of the local area. For example, the audio system receives information about the geometry of the local area from the external system (e.g., a mapping server).

The audio system determines 420 a critical distance for the local area based on the set of critical distance parameters. The critical distance is the distance from the audio source at which the reverberation energy value is equal to the direct energy value for a given frequency band in the local area. In one embodiment, the critical distance is determined by using equation (1). In some embodiments, the critical distance is determined by receiving the critical distance value from the external system (e.g., the mapping server).

The audio system scales 430 an amplitude of the audio content based in part on the critical distance and a distance between a target location and a headset location in the local area. In one embodiment, the amplitude of the reverberant energy of the audio content is scaled. In some embodiments, the amplitude of the direct energy of the audio content is dynamically scaled. In both embodiments, the distance between the target location and the headset location is a known quantity based on the virtual content (e.g., design choices of virtual content creator) presented to the user and the critical distance may be used by a virtual content creator to extrapolate a direct energy to reverberant energy ratio for a virtual audio source that is to be presented at any target location in the local area. Further, the direct energy may be dynamically scaled in proportion to the inverse of the squared distance between the target location and the headset location squared to determine a first sound energy at the distance between the target location in the local area and the headset location. The reverberant energy may be scaled in proportion to the inverse of the squared critical distance for the local area to determine a second sound energy at the critical distance. The ratio of the first sound energy to the second sound energy is a scaling factor that may be used to scale the amplitude of audio content.

An audio system presents 440 audio content in accordance with the scaled amplitude. In one embodiment, the transducer array (e.g., the transducer array 310) of an audio system presents the scaled audio content to the user of the headset. The transducer array may include a plurality of transducers. A transducer may be a speaker (e.g., the speaker 160) or a tissue transducer (e.g., the tissue transducer 170).

Artificial Reality System

Figure 5:
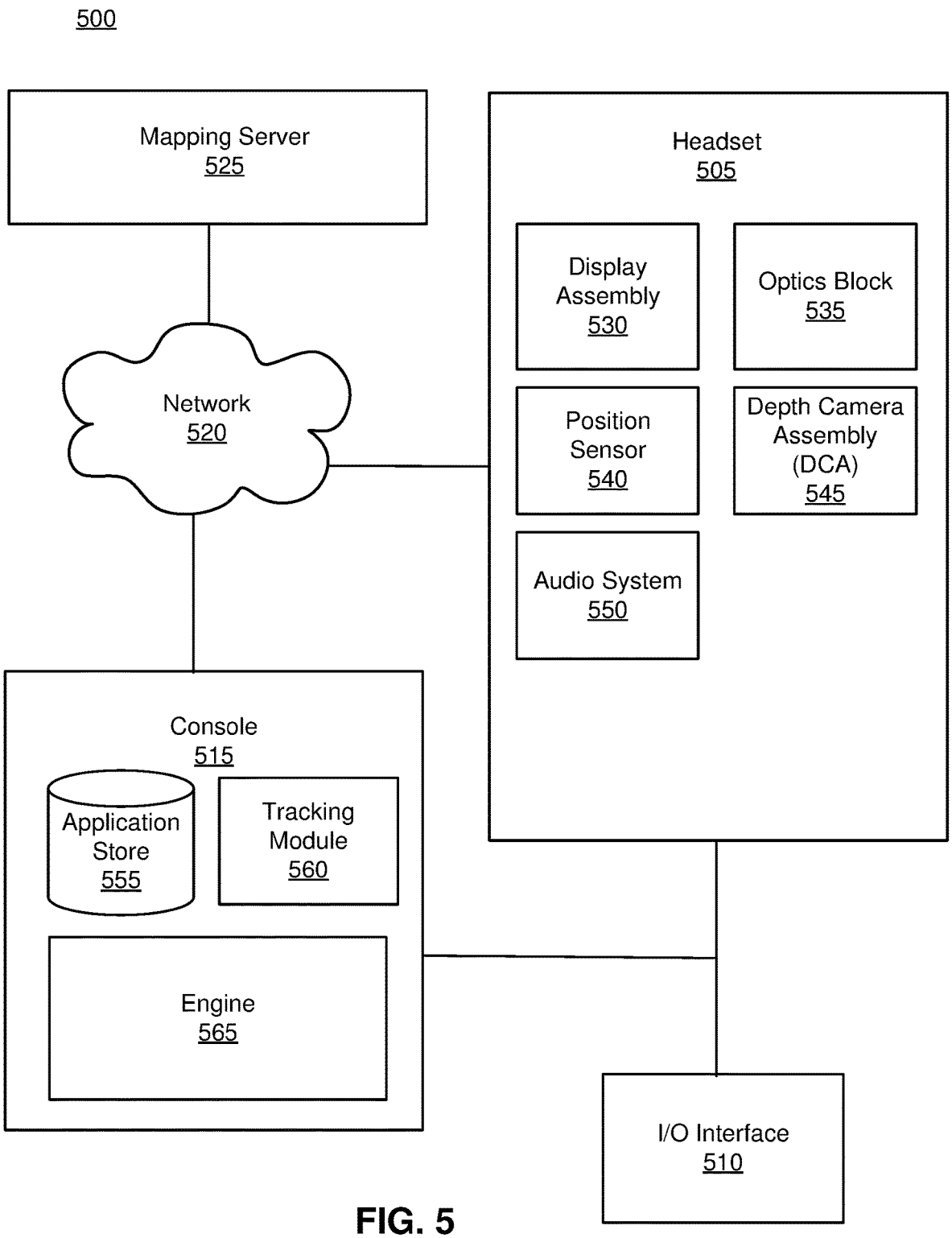
FIG. 5 is a system that includes a headset, in accordance with one or more embodiments.

FIG. 5 is a system 500 that includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUS, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. In one embodiment, the DCA 545 may request the location information of the headset 505 from the mapping server 525 over the network 520. In some embodiments, the DCA controller computes the volume of the local area. When the DCA 545 includes two or more imaging devices, the DCA controller analyzes the captured images to determine the volume of the local area. Operation and structure of the DCA 545 is described above with regard to FIG. 1A.

The audio system 550 provides audio content to a user of the headset 505. The audio system 550 is an embodiment of the audio system 300. The audio system 550 may comprise one or acoustic sensors, one or more transducers, and an audio controller. In one embodiment, the audio system 550 may calculate the acoustic parameters. In some embodiments, the audio system 550 may request the acoustic parameters from the mapping server 525 over the network 520. In some embodiments, the audio system 550 may receive information from the DCA 545 about the geometry of the local area. In one embodiment, the audio system 550 may determine a critical distance based on one or more of the acoustical parameters. In one embodiment, the audio system 550 may request the critical distance from the mapping server 525 over the network 520. The audio system 550 may generate one or more sound filters that scale the amplitude of audio content presented the user of the headset 505. The sound filters may scale the amplitude of the audio content by determining a direct energy to reverberant energy ratio. In one embodiment, the audio system 550 may provide amplitude scaled audio content. The amplitude scaled audio content is audio content presented to the user of the headset 505 that blends seamlessly with real audio content in the local area.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 provides acoustic parameter and location information to the headset 505 (e.g., the audio system 550) via the network 520. The mapping server 525 may include a database that stores depth information, location information, model of the local area, and acoustic parameters. The stored information may be queried based on what type of information the mapping server 525 receives from the headset 505 via the network 520. For example, the mapping server 525 determines (e.g., retrieves) one or more acoustic parameter associated with the received location information. For example, the reverberation time of the local area may be determined by the mapping server 525 by querying the database library by location information and retrieving the associated reverberation time for that particular location information. The mapping server 525 may transmit the one or more of the associated acoustic parameters (e.g., the reverberation time, the geometry of the local area, the critical distance, etc.), to the headset 505 via the network 520. The mapping server 525 may be updated with calculated acoustic parameters, geometries of local areas, and critical distances by the headset 505 via the network 520.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

obtaining a set of critical distance parameters, the set of critical distance parameters including at least a reverberation time of a local area and a geometry of the local area;

determining a critical distance for the local area based on the set of critical distance parameters;

scaling an amplitude of audio content based in part on a ratio of a first sound energy to a second sound energy, the first sound energy determined at a distance between a target location in the local area and a headset location in the local area and the second sound energy determined at the critical distance; and presenting, by an audio system of the headset, the audio content in accordance with the scaled amplitude.

2. The method of claim 1, further comprising:

determining the headset location within the local area, and obtaining the set of critical distance parameters from a database, wherein the database is queried by the headset location.

3. The method of claim 1, wherein the target location is for a virtual audio source, the method further comprising:

obtaining a directivity value for the virtual audio source from a database, wherein the database is queried by a type of virtual audio source; and wherein the set of critical distance parameters further includes the directivity value.

4. The method of claim 1, wherein determining the critical distance for the local area based on the set of critical distance parameters further comprises:

obtaining the critical distance from a database, wherein the database is queried by the set of critical distance parameters.

5. The method of claim 1, wherein the critical distance is associated with a first frequency band, the method further comprising:

obtaining a second set of critical distance parameters, the second set of critical distance parameters including at least a second reverberation time of the local area and the geometry of the local area, wherein the second reverberation time is for a second frequency band different from the first frequency band;

determining a second critical distance for the local area based on the second set of critical distance parameters;

scaling the amplitude of audio content based in part on the second critical distance and the distance between the target location in the local area and the headset location in the local area; and presenting, by the audio system of the headset, the audio content in accordance with the scaled amplitude.

6. The method of claim 1, further comprising:

updating a database with one or more of the set of critical distance parameters and the determined critical distance.

7. A non-transitory computer-readable medium storing instructions that, when executed by one or more processors, cause the one or more processors to perform operations comprising:

obtaining a set of critical distance parameters, the set of critical distance parameters including at least a reverberation time of a local area and a geometry of the local area;

determining a critical distance for the local area based on the set of critical distance parameters;

scaling an amplitude of audio content based in part on a ratio of a first sound energy to a second sound energy, the first sound energy determined at a distance between a target location in the local area and a headset location in the local area and the second sound energy determined at the critical distance; and presenting, by an audio system of the headset, the audio content in accordance with the scaled amplitude.

8. The non-transitory computer-readable storage medium of claim 7, the instructions further cause the one or more processors to perform operations further comprising:

determining the headset location within the local area, and obtaining the set of critical distance parameters from a database, wherein the database is queried by the headset location.

9. The non-transitory computer-readable storage medium of claim 7, wherein the target location is for a virtual audio source, and the instructions further cause the one or more processors to perform operations further comprising:

obtaining a directivity value for the virtual audio source from a database, wherein the database is queried by a type of virtual audio source; and wherein the set of critical distance parameters further includes the directivity value.

10. The non-transitory computer-readable storage medium of claim 7, wherein determining the critical distance for the local area based on the set of critical distance parameters comprises:

obtaining the critical distance from a database, wherein the database is queried by the set of critical distance parameters.

11. The non-transitory computer-readable storage medium of claim 7, wherein the critical distance is associated with a first frequency band, and the instructions further cause the one or more processors to perform operations further comprising:

obtaining a second set of critical distance parameters, the second set of critical distance parameters including at least a second reverberation time of the local area and the geometry of the local area, wherein the second reverberation time is for a second frequency band different from the first frequency band;

determining a second critical distance for the local area based on the second set of critical distance parameters;

scaling the amplitude of audio content based in part on the second critical distance and the distance between the target location in the local area and the headset location in the local area; and presenting, by the audio system of the headset, the audio content in accordance with the scaled amplitude.

12. An audio system comprising:

a transducer array configured to present audio content to a user wearing a headset; and a controller configured to:

obtain a set of critical distance parameters, the set of critical distance parameters including at least a reverberation time of a local area and a geometry of the local area;

determine a critical distance for the local area based on the set of critical distance parameters;

scale an amplitude of audio content based in part on a ratio of a first sound energy to a second sound energy, the first sound energy determined at a distance between a target location in the local area and a headset location in the local area and the second sound energy determined at the critical distance; and present the audio content in accordance with the scaled amplitude.

13. The system of claim 12, wherein the controller is further configured to:

determine the headset location within the local area, and obtain the set of critical distance parameters from a database, wherein the database is queried by the headset location.

14. The system of claim 12, wherein the target location is for a virtual audio source, and the controller is further configured to:

obtain a directivity value for the virtual audio source from a database, wherein the database is queried by a type of virtual audio source; and wherein the set of critical distance parameters further includes the directivity value.

15. The system of claim 12, wherein determining the critical distance for the local area based on the set of critical distance parameters comprises the controller being further configured to:

obtain the critical distance from a database, wherein the database is queried by the set of critical distance parameters.

16. The system of claim 12, wherein the critical distance is associated with a first frequency band, and the controller is further configured to:

obtain a second set of critical distance parameters, the second set of critical distance parameters including at least a second reverberation time of the local area and the geometry of the local area, wherein the second reverberation time is for a second frequency band different from the first frequency band;

determine a second critical distance for the local area based on the second set of critical distance parameters;

scale the amplitude of audio content based in part on the second critical distance and the distance between the target location in the local area and the headset location in the local area; and present the audio content in accordance with the scaled amplitude.

17. The system of claim 12, wherein the controller is further configured to:

update a database with one or more of the set of critical distance parameters and the determined critical distance.

* * * * *